United States Patent [19]

Koshinaka

[11] Patent Number: 4,649,841

[45] Date of Patent: Mar. 17, 1987

[54] SWINGABLE MOUNTING FOR A TRIMMER IN A OVERLOCK MACHINE

[75] Inventor: Osamu Koshinaka, Izumi, Japan

[73] Assignee: Maruzen Sewing Machine Co., Ltd., Moriguchi, Japan

[21] Appl. No.: 856,212

[22] Filed: Apr. 28, 1986

[51] Int. Cl.[4] ..... D05B 37/06; D05B 57/06

[52] U.S. Cl. ..... 112/129; 112/199

[58] Field of Search ..... 112/128, 129, 123 R, 112/199, 122.1, 122.3

[56] References Cited

U.S. PATENT DOCUMENTS 2,893,337 7/1959 Irmscher ..... 112/199

FOREIGN PATENT DOCUMENTS 1000390 1/1986 Japan ..... 112/129

1000391 10/1986 Japan ..... 112/129

*Primary Examiner*—Werner H. Schroeder

*Assistant Examiner*—Andrew M. Falik

*Attorney, Agent, or Firm*—Wenderoth, Lind & Ponack

[57] ABSTRACT

An overlock machine is designed for easy placement of a thread through a looper. The members which would obstruct access to the looper are mounted on a movable portion of a bed frame. By swinging open the movable portion, the obstructing members are moved to their inoperative position. A fixed knife only, or both the fixed knife and the movable knife are mounted on the movable portion.

3 Claims, 11 Drawing Figures

SWINGABLE MOUNTING FOR A TRIMMER IN A OVERLOCK MACHINE

The present invention relates to an overlock machine used to overcast the edge of a cloth.

FIGS. 9 and 10 show two prior art overlock machines. It comprises a bed frame 1 and a bed 2. (FIG. 9) The bed is formed with an opening 4 covered by a throat plate 3 which can be opened. A fixed knife 5 is mounted on a left side wall 6 of the bed frame 1. An elevatable rod 8 is elevatably mounted on guides 9 and 10. A movable knife 11 is fixed to the top end of the elevatable rod 8. A blade 12 on the fixed knife 5 cooperates with a blade 13 on the movable knife 11 to cut the edge of a cloth evenly.

The guides 9, 10 have shafts 14, 15, respectively, which are mounted on the left side wall 6 of the bed frame 1 so as to be retractable. The guide 9 is biassed leftwardly by a spring to press the movable knife 11 against the right side of the fixed knife 5. A roller 17 is coupled to a block 16 fixedly mounted on the elevatable rod 8. A forked lever 18 coupled to a moving part of the machine engages the roller 17, so that the elevatable rod 8 will move up and down as the machine is operated.

In another prior art overlock machine shown in FIG. 10, the fixed knife 5 is fixed to a fitting 20 provided under the bed 2. The movable knife 11 is fixed to one end of a shaft 24 turnably and slidably mounted on a boss 23 which is provided at a front end of a swivel arm 22 having its rear portion mounted on a machine body 21 on the bed 2. As shown in FIGS. 7 and 8, a spring 25 in the boss 23 urges the movable knife 11 leftwardly to press it against the right-hand side face of the fixed knife 5.

The shaft 24 has a pin 28 extending radially and the boss 23 is formed with a notch 29 to receive the pin 28. When the pin 28 is received in the notch 29 as shown in FIG. 7, the movable knife 11 extends downwardly and is pressed by the resilience of the spring 25 against the fixed knife 5. When a knob 30 at the righthand end of the shaft 24 is operated to pull the shaft 24 rightwardly to disengage the pin 28 from the notch 29 and is turned, the movable knife 11 extends forwardly with the pin 28 butting on the right side of the boss 23, as shown in FIG. 8.

In either of two prior art overlock machines, a lower looper 32 is fixed to the top of a swivel lever 34 mounted on a shaft 33 projecting from the bed frame 1. As shown in FIG. 11, the lower looper 32 is formed with a thread hole 35 at its lefthand end viewing from the operator side. The thread is passed through the hole 35, in and along a thread groove 36, and into a thread hole 37 at the other end of the looper 32.

As shown in FIGS. 9 and 10 with dotted lines, the lefthand end of the bed frame 1 is comprised of an auxiliary bed 40 which can be opened. In order to pass a thread through the lower looper 32, a front cover (not shown) is firstly opened and the auxiliary bed 40 is then opened. On the other hand, the thread from a bobbin (not shown) is passed through a thread tension adjusting assembly and a thread guide (both not shown), through a thread guide 41, under the fixed knife 5 and the throat plate 3, or through an opening 42 in the left side wall 6 of the bed frame 1, and pulled out in rear of the lower looper 32. The thread is then passed through the hole 35 of the lower looper 32, guided in the groove 36, and passed through the hole 37 at tip of the lower looper.

As described above, the setting or placement of a thread through the lower looper 32 is very troublesome. In addition, the fixed knife 5, the parts for securing the fixed knife, the bed frame for supporting it, and the bed portion supporting the throat plate 3 and extending forwardly obstruct the sight of the operator to the lower looper 32 and the access of his or her fingers to it. This makes the thread setting on the lower looper very troublesome and time-consuming.

An object of the present invention is to provide an overlock machine which obviates the abovesaid shortcomings.

In accordance with the present invention, the parts and members obstructing the work for setting a thread through the lower looper, which are carried by the movable portion of the bed frame, are adapted to be moved to an inoperative position. Only the fixed knife (in the second embodiment), or both the fixed knife and the movable knife (in the first embodiment) are moved from the front of the lower looper to allow the sight of, and access to, the lower looper. Thus, the operator is given a clear sight of the lower looper and an easy access of his fingers to it. This facilitates the thread setting very much.

Other objects and features of the present invention will become apparent from the following description taken with reference to the accompanying drawings, in which.

Figure 9:
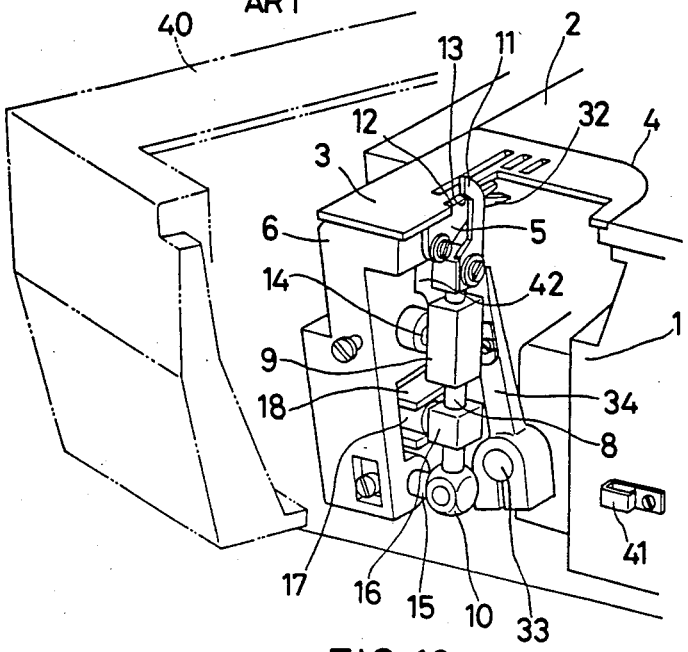
FIG. 9 PRIOR ART
FIGS. 9 and 10 are perspective views of the two prior art overlock machines.

The first embodiment shown in FIGS. 1–4 provides an improvement of the prior art overlock machine shown in FIG. 9. Both the fixed knife 5 and the movable knife 11 are mounted on a movable portion 45 of a bed frame 1. The movable portion is mounted so as to be pivotable around a shaft 46 shown in FIG. 3. A fixed knife 5 is bolted to a mounting surface 44 of the movable portion 45.

Figure 3:
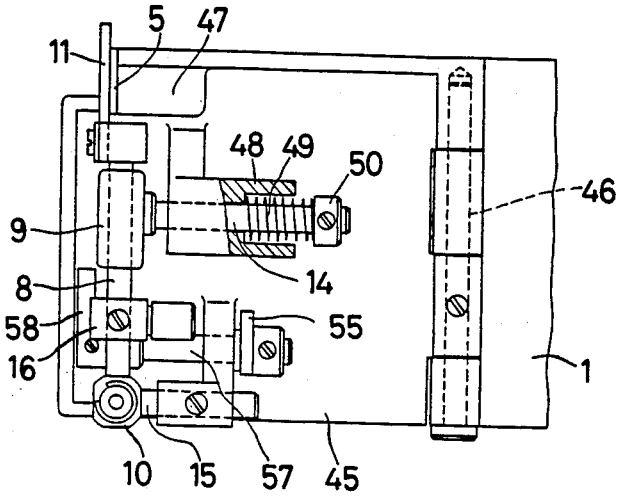
FIG. 3 is a partially sectional rear view of the movable portion of the first embodiment.

A movable knife 11 is mounted on an elevatable rod 8 (FIG. 3). A shaft 14 of a guide 9 on the elevatable rod 8 is retractably mounted in a mounting portion 48 in the movable portion 45. The shaft 14 is biassed by a spring 49 mounted thereon in a hole formed in the shaft at its rear end and supported by a spring support 50 secured to the rear end of the shaft 14 in such a direction as to press the movable knife 11 against the fixed knife 5.

Figure 4:
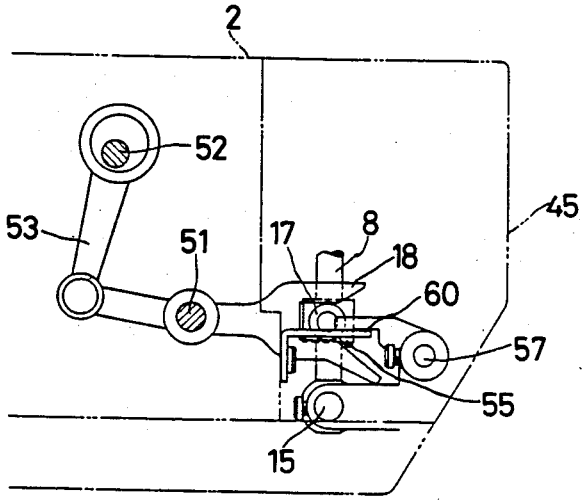
FIG. 4 is a side view showing the driving mechanism for the movable knife in the first embodiment.

A forked lever 18 has its middle portion supported by a shaft 51 and its rear end coupled to a link 53 which is moved up and down by a lower shaft 52 of the machine through an eccentric (FIG. 4). The forked lever 18 has its front portion forked to receive a roller 17 disposed in the movable portion 45.

Figure 1:
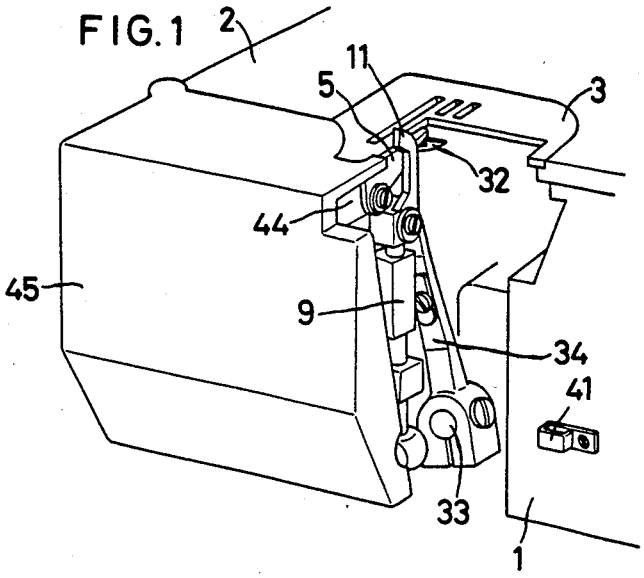
FIG. 1 is a perspective view of the first embodiment with the movable portion of the bed frame closed.
Figure 2:
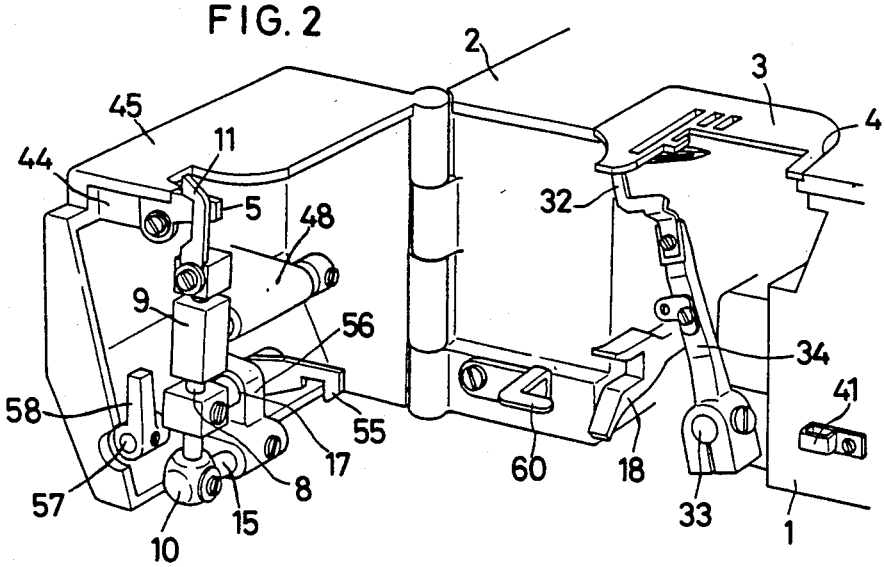
FIG. 2 is a perspective view thereof with the movable portion opened.

A hook 55 (FIGS. 2–4) is secured to the inner end of a transverse shaft 57 turnably mounted in the movable portion 45. A knob 58 is secured to the outer end of the transverse shaft 57. The hook 55 is adapted to engage an engagement piece 60 fixed in the bed frame 1 (FIG. 2). When the movable portion 45 is closed, the hook 55 engages the engagement piece 60 by the action of a spring. By operating the knob 58, the hook 55 can be disengaged from the engagement piece 60.

In the first embodiment, with the movable portion 45 closed, the hook 55 engages the engagement piece 60 and the forked lever 18 engages the roller 17 on the elevatable rod 8. Thus, as the machine operates, the forked lever 18 will pivot up and down, so that the elevatable rod 8 and thus the movable knife 11 will move up and down.

When passing a thread through the lower looper 32, the knob 58 is operated to disengage the hook 55 from the engagement piece 60. Now, the movable portion 45 can be swung to its inoperative position as shown in FIG. 2. This allows the sight of and access to the lower looper 32. Setting a thread on it is now very easy.

Figure 5:
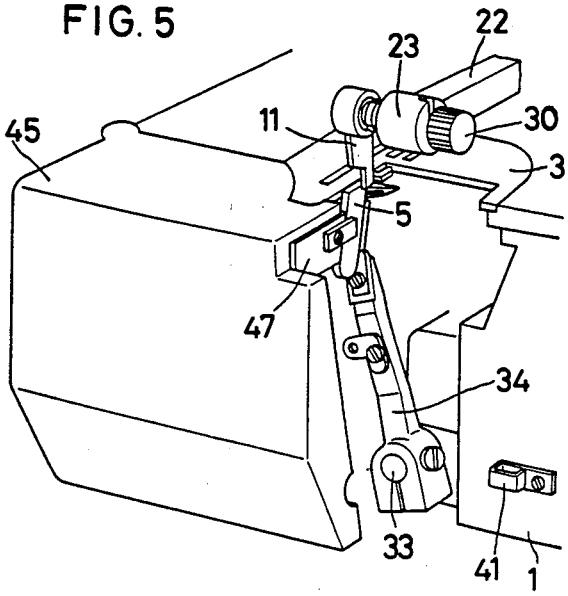
FIG. 5 is a perspective view of the second embodiment with the movable portion of the bed frame closed.
Figure 6:
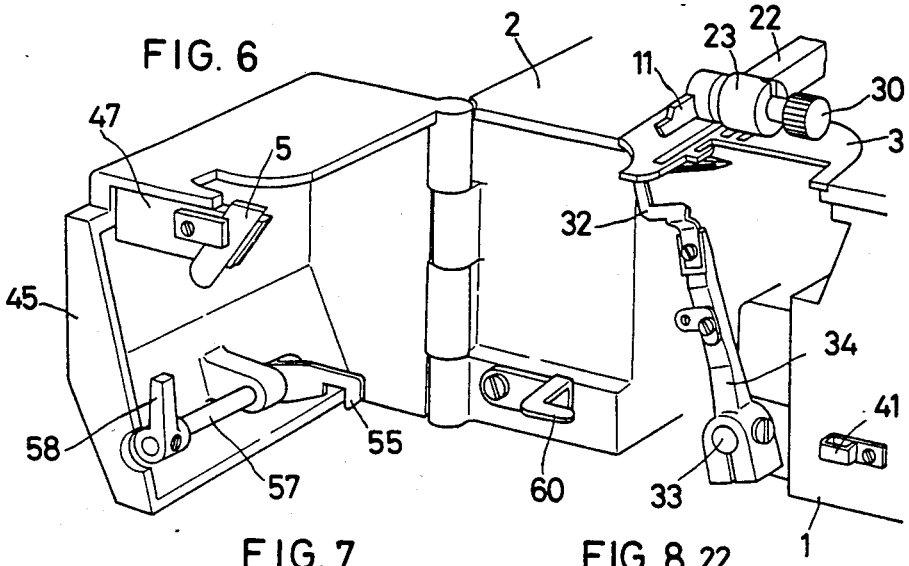
FIG. 6 is a perspective view thereof with the movable portion opened.
Figure 7:
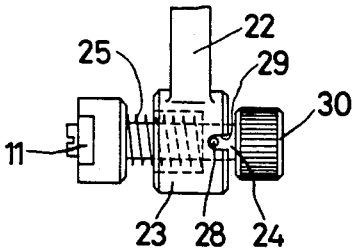
FIGS. 7 and 8 are enlarged plan views showing how the movable shaft is mounted.
Figure 8:
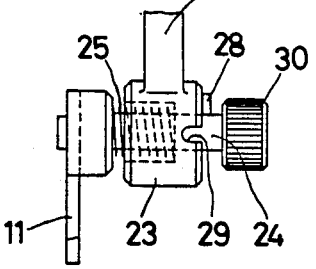
Figure 10:
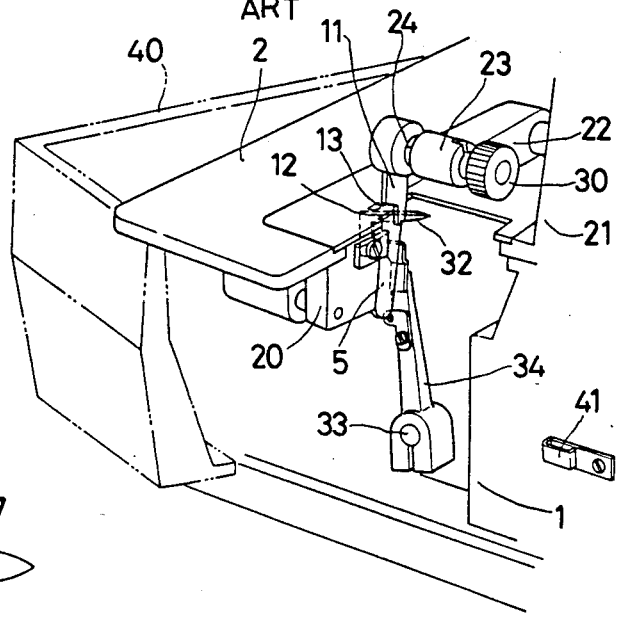
FIG. 10 PRIOR ART
Figure 11:
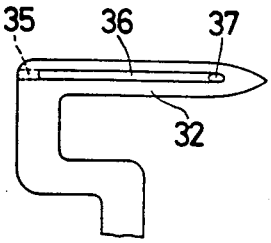
FIG. 11 is a partially cutaway front view of the lower looper.

The second embodiment shown in FIGS. 5 and 6 provides an improvement of the prior art overlock machine shown in FIG. 10. The movable knife 11 is supported in the same manner as in the prior art overlock machine, as shown in FIGS. 7 and 8 and described before. Only the fixed knife 5 is secured to a mounting plate 47 secured to the movable portion 45. In the second embodiment, too, a hook 55 and a knob 58 are fixedly mounted on a transverse shaft 57 rotatably mounted on the movable portion 45, as in the first embodiment. The hook 55 is adapted to engage an engagement piece 60 secured to the bed frame 1.

In the second embodiment, too, with the movable portion 45 closed, the hook 55 engages the engagement piece 60. With the movable knife 11 extending downwardly and the pin 28 engaged in the notch 29 in the boss 23 as shown in FIG. 7, the movable knife 11 is pressed against the fixed knife 5, as shown in FIG. 5, and moves up and down, as the machine operates, to cut the cloth edge evenly.

In order to set a thread through the lower looper 32, the shaft 24 is pulled with the knob 30 against the bias of the spring 25 to disengage the pin 28 from the notch 29 and is turned to the position shown in FIG. 8 where the movable knife 11 faces to the front.

When the lower knob 58 is operated to disengage the hook from the engagement piece 60 and the movable portion 45 is swung open to its inoperative position as shown in FIG. 6, there is no obstruction to the sight of and access to the lower looper 32, as in the first embodiment. Now, a thread can be easily set through the lower looper.

Although in the preferred embodiments, the movable portion 45 is adapted to be pivoted sidewise, it may be adapted to be pivoted downwardly to be pulled out, or to be moved to its inoperative position in any other way.

Although in the embodiments a forked lever 18 is coupled to the machine body and the roller 17 is used to move the movable knife up and down, a roller may be used instead of the forked lever and a forked lever may be used instead of the roller.

What we claimed are:

1. An overlock machine comprising a bed frame, a fixed knife, a movable knife cooperating with said fixed knife to cut the edge of a cloth, a support member adapted to be coupled to a moving part of the machine for supporting said movable knife, and a lower looper provided rearwardly of said fixed knife and said movable knife, characterised in that said bed frame has a movable portion adapted to be moved to an inoperative position so as not to obstruct the viewing of and the access to said lower looper for the placement of a thread through said lower looper, at least one of said knife means being mounted on said movable portion of said bed frame, said movable portion being provided with engagement means for releasable engagement with a body portion of said bed frame.

2. An overlock machine as claimed in claim 1, wherein said fixed knife only is fixedly mounted on said movable portion of the bed frame.

3. An overlock machine as claimed in claim 1, wherein both said fixed knife and said movable knife and said support member for said movable knife are mounted on said movable portion of the bed frame.

* * * * *